US005238216A

United States Patent [19]

Pawlik

[11] Patent Number: 5,238,216

[45] Date of Patent: Aug. 24, 1993

[54] APPARATUS FOR MODIFYING THERMAL GRADIENT FOR CASTING IN GRAPHITE MOLDS

[75] Inventor: John L. Pawlik, Bartlett, Ill.

[73] Assignee: Amsted Industries Incorporated, Chicago, Ill.

[21] Appl. No.: 753,092

[22] Filed: Aug. 30, 1991

[51] Int. Cl.[5] ..... B22C 9/28

[52] U.S. Cl. ..... 249/56; 249/111; 249/112; 249/134

[58] Field of Search ..... 249/56, 105, 106, 109, 249/111, 112, 113, 114.1, 134

[56] References Cited

U.S. PATENT DOCUMENTS

| | | | |
|---|---|---|---|
| Re. 24,655 | 6/1959 | Sylvester | 164/27 |
| 401,804 | 4/1889 | Washburn | 249/56 |
| 3,302,919 | 2/1967 | Beetle et al. | 249/56 |
| 3,409,267 | 11/1968 | Wszolek | 249/105 |
| 3,480,070 | 11/1969 | Beetle et al. | 249/56 |
| 3,498,366 | 3/1970 | Merrick et al. | 164/368 |
| 3,614,053 | 10/1971 | Peck | 249/105 |
| 3,684,004 | 8/1972 | Germain et al. | 164/364 |

*Primary Examiner*—Jay H. Woo
*Assistant Examiner*—James P. Mackey
*Attorney, Agent, or Firm*—Edward J. Brosius; F. S. Gregorczyk; Thomas J. Schab

[57] ABSTRACT

In a casting mold, refractory filled segments are provided between adjacent riser seats to provide more uniform and more controlled cooling of the molten metal to reduce microporosity in the cast product.

5 Claims, 4 Drawing Sheets

APPARATUS FOR MODIFYING THERMAL GRADIENT FOR CASTING IN GRAPHITE MOLDS

BACKGROUND OF THE INVENTION

The present invention is directed to an improved graphite mold for casting. More specifically the invention provides a method and apparatus to improve riser practice and control of the casting process especially in large castings to reduce porosity in these castings and thus improve their internal structural integrity.

Castings have been produced for centuries in various molds and forms, including sand molds, permanent dies and graphite molds. The materials cast include molten bronze, brass, iron, aluminum and steel, as well as other elements and alloys. Casting techniques have developed to accommodate the properties of the material being cast, the required or desired surface quality of the finished casting, the requisite structural integrity of the cast product, as well as the cost of the casting technique or practice. Indicative of some of the first casting practices was the tapping of molten iron from a crude smelter or blast furnace into a mold formed in the sand or dirt in Biblical times. Casting practices have evolved and been refined to provide better control of the melt chemistry, tap temperature, mold temperature, pouring rates, ladle apparatus as well as other casting and teeming techniques. Among the more progressive practices is the selection of mold materials to promote longer wearing dies, to yield improved control of heat transfer rates, and to provide smoother surfaces on the as-cast product.

Graphite molds are utilized in the casting and foundry industry for their efficient heat transfer properties, and their relatively high resistance to wear and erosion, which leads to an increase in the number of casts per mold and more rapid cooling of the cast articles in the mold. These graphite molds are also utilized in the foundry industry to provide greater dimensional control of the as-cast product, which reduces secondary finishing operations and provides a product ready for shipment. As in most foundry mold and casting apparatus, these graphite molds are provided with pouring gates and risers, which permit discharge of gases and vapors during casting and solidification. The high heat transfer rate of the graphite is both a boon and a bane, as it allows for rapid heat transfer from the molten metal, but can also lead to an increase in the occurence of porosity in the solidified casting. Therefore, it has been found to be desirable to not only control the mass rate of cooling, but also to locally control the rate of cooling in the various regions of the casting. That is, it is beneficial to vary the cooling rate for both the thinner and the thicker casting sections to promote a more uniform rate of cooling and solidification through each of the sections of the casting in the mold.

Molds, mold structures and mold practices vary across a wide range of apparatus, as exemplified by structures discussed and illustrated in *Foundry Work*, by R.E. Wendt, Fourth Edition, 1942, and *Cast Metals Technology*, by J.Gerin Sylvia, 1972. Although these texts span three decades, many of the methods and apparatus are the same or similar. The improvements in the technology noted in the latter text relate to an understanding of the kinetics of the operation and the chemical practices, however, the mold components have largely remained the same, that is the gate, riser, mold cavity, cope and drag among others. Although these basic components remain part of the art, there have been continuous efforts to improve the casting practice, mold structure and metal chemistry with the intent of improving the finished product, its internal structure and the finished surface.

U.S. Pat. No. 3,614,053 to Peck is illustrative of efforts to improve casting and discloses a riser assembly for a two-part mold, which riser has a pair of sections resiliently and pivotally mounted on the respective mold parts. As the mold parts are joined to provide a casting cavity the riser pair is simultaneously coupled to provide a sealed riser cavity. This arrangement was utilized to expedite and enhance the casting cycle rate through the mold.

Alternative mold riser structures are taught and illustrated in U.S. Pat. Nos. 3,409,267 to Wszolek; 3,498,366 to Merrick et al; and, Re. 24,655 to Sylvester. The latter patent to Sylvester provides a technique for forming and baking riser cups in the riser openings of molds. These cups are a nonflammable material such as core sand and dry binder baked to provide a smooth strong cup with walls, which will vent gas from the reaction between the molten metal and the graphite. The Merrick et al—'366 patent has resin-bonded sand portions in a graphite mold to provide improved surface conditions of the as-cast articles, and to produce chilled wear surfaces at the graphite contacting portions as well as softer surfaces at the sand contacting portions of the cast article. A riser with a separate, relatively large and reusable upper section is illustrated in the noted Wszolek patent.

Other casting and foundry techniques utilized to prolong mold life and to produce improved castings are exemplified by the utilization of mold washes to coat the casting surfaces of the mold, such as taught in U.S. Pat. No. 3,684,004 to Germain et al. On a mold face with a centrally located ingate, a mold-wash coating thickness varies inversely with the distance from the centerline of the mold. These mold washes are generally applied by spraying the mold casting surfaces with a slurry of coating material, such as quartz, zircon, cristobalite or the like. This patent provides a means to avoid the laps, wrinkles and discontinuities from the mold-coating process.

The desire for improved cast products extends to all facets of the casting, that is the chemical composition, crystallographic structure, physical properties, surface finish, minimal material losses, grinding requirements, and structural integrity. This latter parameter is especially important in castings subject to mechanical work and wear, or which castings may bear either intermittent or continuous heavy loads. This improved quality requirement is exemplified by cast railroad wheels, which are subject to wear, heavy vertical and torsional loading, and abrasion. These difficult physical requirements place a premium on the provision of a quality casting, and one of the primary characteristics of a structurally sound casting is the continuity or the minimization of microporosity in the casting. This casting soundness is monitored by ultrasonic testing and is indicative of, or at least considered to be an indicator of, a high quality railroad wheel for the strenuous service requirement. Earlier casting practice measures to improve the structural integrity of the cast railroad wheels have included an increase in the number of risers, as well as positioning the risers in communication with the web section of the mold cavity to improve the gas and vapor discharge and to provide a source of hot metal to fill the voids as the casting cools and contracts. It has been considered necessary to continuously fill the casting cavity with hot metal to minimize microporosity in the castings.

SUMMARY OF THE INVENTION

The present invention provides a graphite mold for castings and is specifically adaptable to casting railroad wheels, especially Diesel wheels. The wheels are cast in molds with a plurality of risers to provide a continuous supply of molten metal to the webbing, flange and wheel rim, which wheel sections may be the first to cool, contract and shrink. The risers in the cope are open at the cope upper surface and the mold cavity, and are provided with an insulating sleeve of a refractory material. The plurality of risers is typically arranged in a circular pattern concentric with the wheel hub. The riser openings at the mold face appear as a plurality of ports, each surrounded by an annulus and arranged on a circumference with mold face arcs portending between the riser openings. The invention provides an arced recess between each of the adjacent mold-face riser ports, which ports, risers and arcs are filled with a refractory material to inhibit the rate of heat transfer from the molten metal in the mold cavity during metal solidification and to reduce microporosity formation from rapid cooling of the cast metal in the wheel webbing. In the preferred embodiment, the arced recesses are formed with a rounded root and have a generally hemispherical cross-section, which aids in the dislodgement of the refractory material after cast-product removal, thereby aiding in mold preparation for the next casting.

BRIEF DESCRIPTION OF THE DRAWING

In the figures of the Drawings, like reference numerals identify like components, and in the drawings.

DETAILED DESCRIPTION OF THE PREFERRED EMBODIMENT

Figure 1:
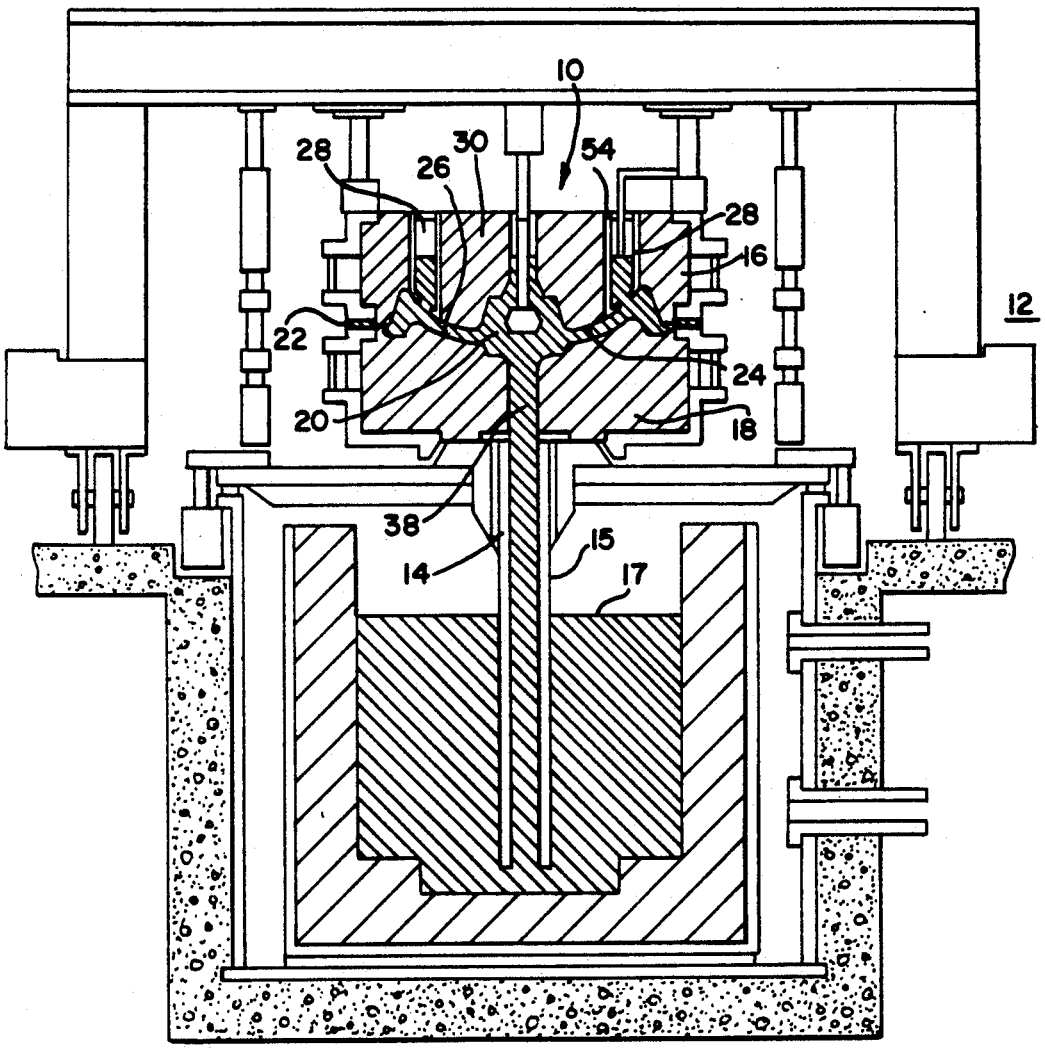
FIG. 1 is an elevational view in cross-section of a graphite mold and bottom pressure pouring process.
Figure 6:
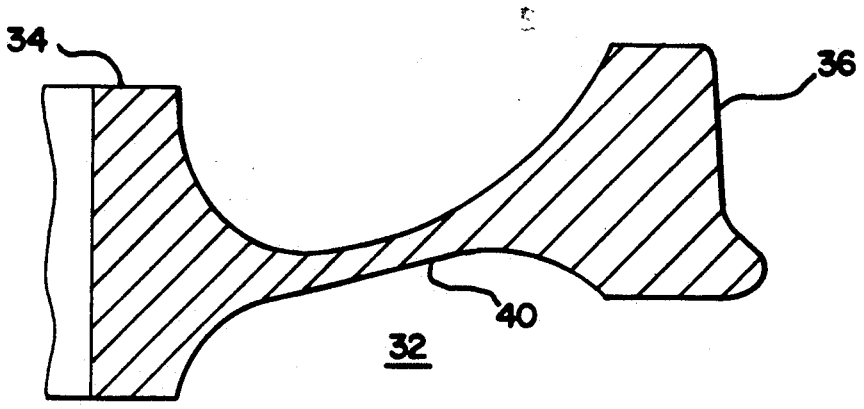
FIG. 6 is a cross-sectional view of a typical railroad wheel from the centerline of the hub to the wheel rim; and, FIG. 7 is an elevational view of a tool for cutting an arced recess with a root radius in the surface of a graphite mold.

A graphite mold 10 for casting a railroad wheel in mold cavity 20 is illustrated in FIG. 1 in an apparatus 12 for bottom pressure pouring. The particular pouring process, product being cast and the casting apparatus are illustrative, and not a limitation to the structure of the present invention. Mold 10 has gate 14 with an extending tubular member 15 communicating between the metal bath 17 in apparatus 12 and mold cavity 20. Cope 16 and drag 18 of mold 10 are connected at parting line 22, and have lower face 24 and upper face 26, respectively, in juxtaposed position to provide cavity 20 therebetween. Risers 28 extend from lower face 24 to top surface 30 of cope 16 and are discharge passages for gases and vapors, as well as providing a reservoir for molten metal to fill cavity 20 during casting solidification and minimize microporosity in the cast wheel. An illustrative cross section of a railroad wheel 32 is shown in FIG. 6, which is a section from wheel hub 34 to rim 36. In the illustrated process, molten metal in bath 17 is communicated to mold cavity 20 through tube 15 and gate 14, however, alternate processes may be utilized with mold 10.

Drag 18 has upper or cavity face 26, which is a generally continuous face with no discontinuities except hub bore 38. The contour of upper face 26 accommodates the surface of the inner surface 40 of wheel 32 and is expected to provide a relatively smooth wheel surface, minimal opportunities for porosity and voids due to the effects of gravity, and a continuous supply of hot molten metal to fill any developing voids during casting cooling and contraction. Drag 18 is a graphite mold section with a high rate of heat transfer to expedite casting cooling and to promote higher rates of production. In addition, the wear rate of the graphite mold is relatively nominal and any eroded or spalled graphite has little or no effect on the chemistry of a cast-iron or steel casting as it may be taken into solution as carbon or as an inclusion in the grain boundaries indistinct from the carbon of the alloy.

As noted above, cope 16 and drag 18 are nested or coupled at parting line 22, which is generally the outer edge of the cope and drag sections. Cope 16 in FIGS. 2–4 has a convex contour at lower surface 24 that is juxtaposed to the concave form at drag upper surface 26 to form cavity 20. In the illustrated railroad wheel outline of FIG. 6, relatively thin web portion 40 connects the rim segment 36 with hub segment 34, and it is in proximity to the outer or rim segment 36 that risers 28 open into cavity 20. The precise position of the risers in cope 16 and thus their position to casting cavity 20 is a design choice, but in this railroad wheel example the riser position is as noted.

Risers 28 are utilized in the casting industry to vent mold cavity 20 and to provide reservoirs of hot metal to accommodate shrinkage of the casting during cooling, which leads to porosity or "pipe" in an ingot mold. Although porosity is a natural occurrence in castings, whether they are ingot or die castings, porosity may be detrimental to the structural integrity of the finished product, which may be used as-cast or subject to secondary finishing operations. Consequently, the wheel casting industry has continued to search for methods, apparatus and chemistry to improve wheel production.

Figure 2:
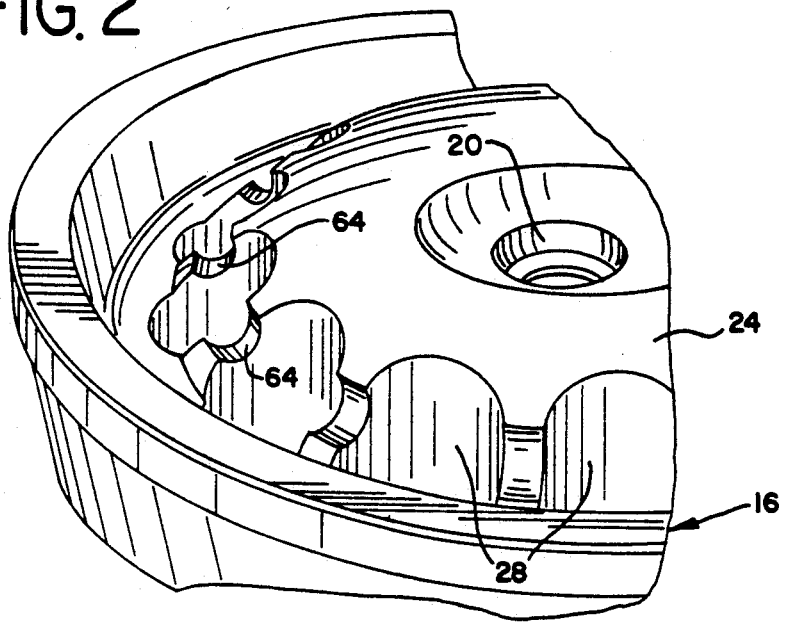
FIG. 2 is an enlarged, fragmentary perspective view of lower or mold-cavity face of the cope with unfilled risers, counterbores and arced recess for a casting mold, as in FIG. 1.
Figure 3:
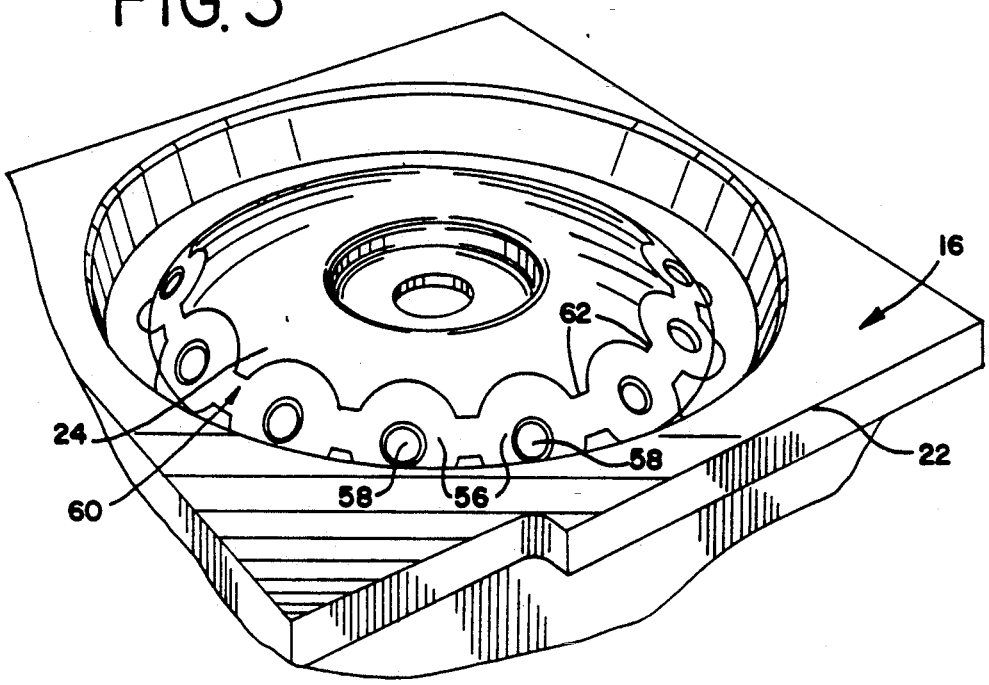
FIG. 3 is an enlarged perspective view of the mold-cavity the cope in FIG. 2 with the risers, counterbores and recessed band filled with an insulating material.
Figure 4:
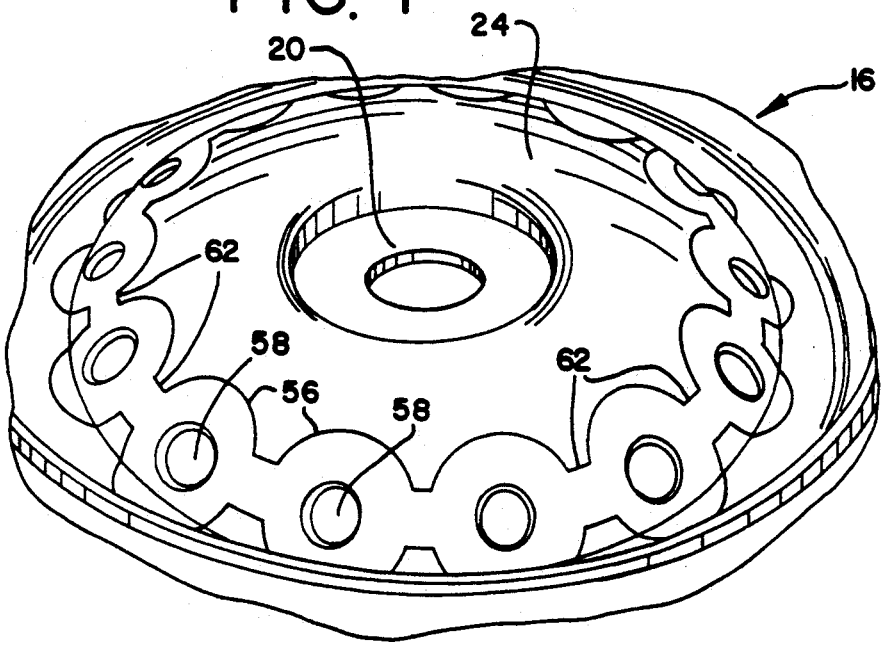
FIG. 4 is an alternative perspective view of the mold face in FIG. 3.
Figure 5:
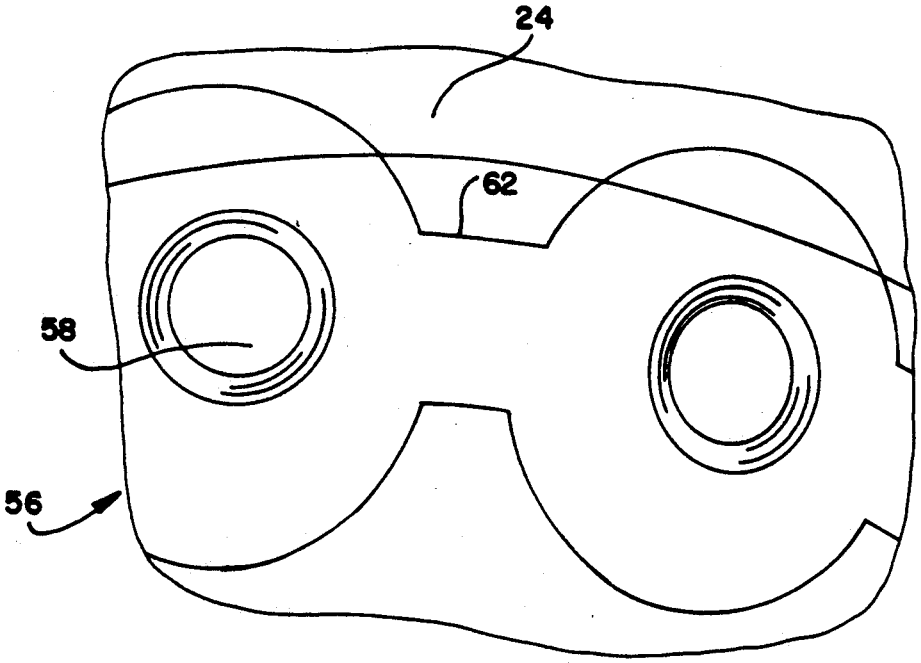
FIG. 5 is an enlarged view of two risers and counterbores joined by a recessed band segment of the mold face in FIG. 4.

Riser 28 in FIG. 1 is a cylindrical passage 50 with a sidewall 52, and a refractory sleeve liner 54. Riser 28 extends from top surface 30 through cope 16 to mold cavity 20 and is flush with both surfaces at upper and lower ends 51 and 53, respectively, of passage 50. More specifically, sleeve liner 54 is flush with the surfaces at upper and lower ends 51, 53 of passage 50. Risers 28 in cope 16 of FIG. 2 terminate at lower surface 24; and, counterbores 56 at surface 24 in FIGS. 3–5 provide enlarged seats for sleeve liners 54. In the illustrated embodiment, liners 54 may be formed by filling riser 28 and counterbore 56 with a refractory material having a binder or other heat sensitive reactant. Mold 10 is generally at a temperature elevated above room temperature by the previous hot metal casting or it may be preheated to a predetermined temperature to avoid casting problems, which heat and temperature are adequate to cure the refractory mixture. The refractory material in riser passage 50 is allowed to cure for a predetermined length of time, which hardens the refractory mixture to a given wall thickness. Subsequent inversion of cope 16 discharges the remaining portion of the uncured refractory material and provides a bore or passage 50. However, the refractory material at lower surface 24 and counterbore 56 generally completely cures, which requires drilling or otherwise boring the material from passage 50 to open port 58 at counterbore 56. In the figures, the refractory filled counterbores 56 appear as washers or annular seats, which act as excellent insulators during cooling of the casting.

Historically the practice has developed to provide an additional number of risers 28 to promote a more structurally sound casting with reduced microporosity. This was especially true in the railroad wheel industry where demand for structural integrity is coupled to operating safety. Thus, an alternative casting practice developed for the production of Diesel locomotive wheels, which practice utilized an increased number of risers to compensate for the shrinkage of a cooled casting and to minimize the microporosity in the finished cast wheel. The casting practice using an increased number of risers 28 was successful in lowering microporosity. However, a thermal gradient exists between the adjacent counterbores 56, which counterbores were filled with the refractory material. This thermal gradient was attributed to the difference in thermal conductivity between the refractory material of the sleeve liner and the graphite of mold 10. Therefore, recessed band 60 in FIG. 2 is formed in lower surface 24 to minimize the thermal gradient between each set of adjacent counterbores 56. In the several figures, band 60, which may have a band width about equal to the riser diameter and a band depth about one-half the riser diameter, extends completely around lower surface 24 and appears as a series of arcs 62 connecting adjacent counterbores 56. In a preferred embodiment, band 60 is rounded at its root 64, as noted in FIG. 2, and has a band width at least equal to the riser passage diameter to provide ease of refractory removal after each cast heat, however, the precise cross-sectional shape of the band is not a limitation.

Figure 7:
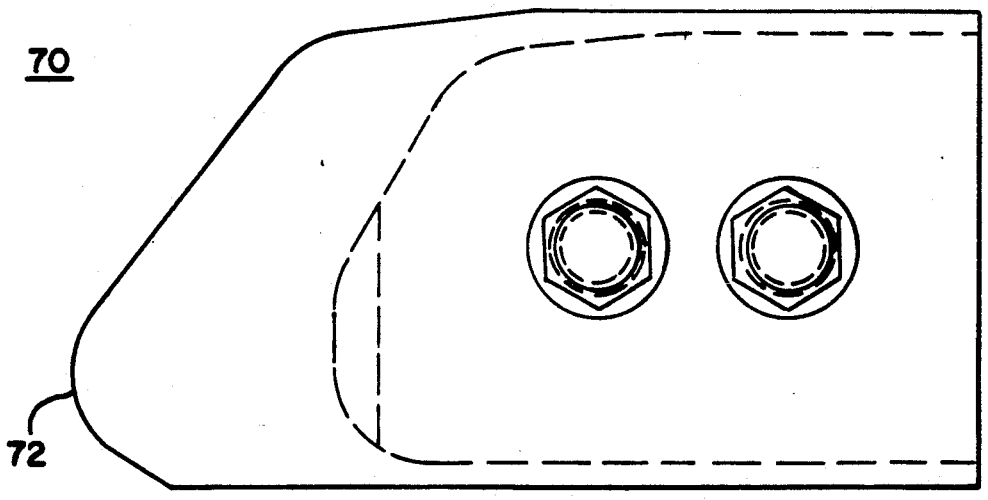

As an expedient to the preparation and development of band 60 in lower surface 24, tool 70, which is shown in FIG. 7 with a predetermined radius at its cutting edge 72, may be used as a machining tool to cut band recess 60 in surface 24 to a desired depth and with a rounded shape at recess root 64, which rounded shape may be hemispherical in cross-section with a radius about one-half the riser diameter. After formation of band 60, both band 60 and riser passage 50 are filled with the binder-laced refractory for simultaneous curing. Thereafter, cope 16 is inverted to discharge the uncured refractory and port 58 is drilled, punched or otherwise opened to provide open communication through riser 28 in cope 16.

More specifically, the contour of lower and upper mold faces 24 and 26, respectively, are machined in the mold surfaces as the graphite molds 10, which are semi-permanent molds for reuse in producing multiple castings, are susceptible to wear and erosion. Consequently, molds 10 are dissembled and each of cope 16 and drag 18 are secured in a chuck of a lathe, mill or other machining apparatus (not shown) for remachining lower and upper surfaces 24 and 26 for subsequent reuse and casting. Tools for forming the various contours on faces 24 and 26 may be mounted in a boring bar, and tool 70 may similarly be mounted in such a boring bar to trace arced recess 60 into face 24 between the adjacent risers 28.

In operation, mold 10 continues to generally appear as its historical predecessor, however, band 60 in cooperation with counterbores 56 at lower face 24 presents a continuous refractory or insulating annulus to the molten metal in cavity 20. Thus, it is expected that the thermal cooling effects in the region around counterbores 56 and risers 28 will be more uniform and inhibit some of the thermal gradient cooling effect, which results in more uniform cooling of a cast product and an inhibition to casting microporosity. After cooling, the casting may be removed in the usual manner and the mold cope 16 and drag 18 may be handled in conformance with normal foundry practice to discharge the refractory material therefrom.

While only a specific embodiment of the invention has been described and shown, it is apparent that various alternatives and modifications can be made thereto. Those skilled in the art will recognize that certain variations can be made in this illustrative embodiment. It is, therefore, the intention in the appended claims to cover all such modifications and alternatives as may fall within the true scope of the invention.

I claim:

1. A graphite mold for casting railroad wheels, said mold comprising a drag portion with an upper face having a first shape therein, and a cope portion with a top surface and a lower face having a second shape therein, which first and second shapes are alignable at matching of said cope and drag portions to define a casting cavity, said cope portion having at least two risers communicating between said top surface and said lower face and cavity;

each said riser being generally cylindrical and having a cross-sectional diameter, which risers are open at said lower face;

a trenched band in said lower face, which band extends between each adjacent pair of risers at said lower face to provide a generally circumferential band at said lower face;

an insulating material provided in each said riser and said trenched band, said insulating material in each said riser providing a port at said lower face and an annulus at said lower face having an outer diameter greater than a width of said trenched band at said lower face, said insulating material in said trenched band cooperating with said cope portion lower face and said annulus at each said riser to provide a generally continuous surface at said cope portion lower face, which insulating material arrangement enhances the cooling and heat transfer of molten metal in said mold to promote control of solidification of a cast railroad wheel.

2. A graphite mold for casting railroad wheels as claimed in claim 1 wherein each said riser is countersunk at said lower face to provide a countersunk recess which receives said annulus.

3. A graphite mold for casting railroad wheels as claimed in claim 2 wherein said trenched band has a width at said lower face approximately equal to said riser cross-sectional diameter.

4. A graphite mold for casting railroad wheels as claimed in claim 3 wherein said trenched band has a band depth from said lower face into said cope portion about equal to one-half said cross-sectional diameter.

5. A graphite mold for casting railroad wheels as claimed in claim 1 wherein said trenched band has a hemispherical cross-section with a radius about equal to one-half said cross-sectional diameter.

* * * * *